US010597741B2

(12) United States Patent
Fushiwaki et al.

(10) Patent No.: US 10,597,741 B2
(45) Date of Patent: Mar. 24, 2020

(54) HIGH-STRENGTH STEEL SHEET AND METHOD FOR MANUFACTURING THE SAME

(71) Applicant: JFE STEEL CORPORATION, Tokyo (JP)

(72) Inventors: Yusuke Fushiwaki, Fukuyama (JP); Yoshiyasu Kawasaki, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 884 days.

(21) Appl. No.: 15/038,223

(22) PCT Filed: Nov. 13, 2014

(86) PCT No.: PCT/JP2014/005703
§ 371 (c)(1),
(2) Date: May 20, 2016

(87) PCT Pub. No.: WO2015/075911
PCT Pub. Date: May 28, 2015

(65) Prior Publication Data

US 2016/0289784 A1 Oct. 6, 2016

(30) Foreign Application Priority Data

Nov. 22, 2013 (JP) ..... 2013-241539

(51) Int. Cl.

| | |
|---|---|
| ***C21D 1/74*** | (2006.01) |
| ***C21D 9/56*** | (2006.01) |
| ***C25F 1/06*** | (2006.01) |
| ***C22C 38/06*** | (2006.01) |
| ***C21D 9/46*** | (2006.01) |
| ***C22C 38/00*** | (2006.01) |
| ***C22C 38/60*** | (2006.01) |
| ***C21D 8/04*** | (2006.01) |
| ***C21D 1/76*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |

(52) U.S. Cl.
CPC ..... *C21D 1/74* (2013.01); *C21D 1/76* (2013.01); *C21D 8/0447* (2013.01); *C21D 9/46* (2013.01); *C21D 9/56* (2013.01); *C22C 38/00* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/60* (2013.01); *C25F 1/06* (2013.01); *C21D 2211/008* (2013.01)

(58) Field of Classification Search
CPC ..... C21D 1/74; C21D 1/76; C21D 8/0447; C21D 9/56; C21D 9/46; C21D 2211/008; C22C 38/002; C22C 38/16; C22C 38/18; C22C 38/02; C22C 38/04; C22C 38/08; C22C 38/12; C22C 38/14; C22C 38/60; C22C 38/06; C22C 38/00; C25F 1/06
See application file for complete search history.

(56) References Cited

U.S. PATENT DOCUMENTS

| | | | | |
|---|---|---|---|---|
| 5,141,606 | A * | 8/1992 | Matsumoto | C25F 1/00 205/712 |
| 9,074,275 | B2 | 7/2015 | Fushiwaki et al. | |
| 2010/0237548 | A1 | 9/2010 | Okada et al. | |
| 2011/0048589 | A1* | 3/2011 | Matsuda | C21D 1/18 148/645 |
| 2011/0083774 | A1 | 4/2011 | Jin et al. | |
| 2012/0090737 | A1 | 4/2012 | Fushiwaki et al. | |
| 2012/0222781 | A1 | 9/2012 | Azuma et al. | |
| 2013/0306203 | A1 | 11/2013 | Fushiwaki et al. | |
| 2013/0327452 | A1 | 12/2013 | Fushiwaki et al. | |
| 2015/0044503 | A1* | 2/2015 | Fushiwaki | C23C 2/06 428/659 |

(Continued)

FOREIGN PATENT DOCUMENTS

| | | | |
|---|---|---|---|
| CN | 102369305 | A | 3/2012 |
| EP | 2415896 | A1 | 2/2012 |
| EP | 2623630 | A1 | 8/2013 |

(Continued)

OTHER PUBLICATIONS

Dec. 12, 2016 Search Report issued in European Patent Application No. 14864101.2.
Apr. 24, 2015 Office Action issued in Japanese Patent Application No. 2013-241539.
Dec. 2, 2016 Office Action issued in Chinese Patent Application No. 201480063266.9.

(Continued)

*Primary Examiner* — Anthony J Zimmer
(74) *Attorney, Agent, or Firm* — Oliff PLC

(57) ABSTRACT

A high-strength steel sheet and a method for manufacturing a high-strength steel sheet having excellent phosphatability and excellent corrosion resistance after electrodeposition coating has been performed, even in the case where the contents of Si and Mn are high. The method may comprise annealing a steal sheet by using a continuous annealing method, performing a heating process, controlling the maximum end-point temperature of a steel sheet in the annealing furnace, controlling the traveling time of the steel sheet, and controlling the dew point of the atmosphere.

4 Claims, No Drawings

(56) References Cited

U.S. PATENT DOCUMENTS

2016/0289784 A1 10/2016 Fushiwaki et al.

FOREIGN PATENT DOCUMENTS

| | | | | |
|---|---|---|---|---|
| EP | 2623631 | A1 | | 8/2013 |
| EP | 2829627 | A1 | | 1/2015 |
| JP | S49-52715 | A | | 5/1974 |
| JP | S55-145122 | A | | 11/1980 |
| JP | H05-320952 | A | | 12/1993 |
| JP | H06-10096 | A | | 1/1994 |
| JP | 2003-113441 | A | | 4/2003 |
| JP | 2004-323969 | A | | 11/2004 |
| JP | 2006-045615 | A | | 2/2006 |
| JP | 2010-255109 | A | | 11/2010 |
| JP | 2010-255110 | A | | 11/2010 |
| JP | 2010255110 | A | * | 11/2010 |
| JP | 2012-072450 | A | | 4/2012 |
| JP | 2012-072465 | A | | 4/2012 |
| JP | 2012-251239 | A | | 12/2012 |
| JP | 2013-194270 | A | | 9/2013 |
| JP | 2014-015675 | A | | 1/2014 |
| WO | 2013140729 | A1 | | 9/2013 |
| WO | 2014/017010 | A1 | | 1/2014 |

OTHER PUBLICATIONS

Feb. 17, 2015 Search Report issued in International Application No. PCT/JP2014/005703.

May 23, 2018 Office Action issued in U.S. Appl. No. 14/771,270.

Nov. 2, 2017 Office Action issued in European Patent Application No. 14864101.2.

Jul. 23, 2018 Office Action issued in Korean Patent Application No. 2016-7016521.

Jul. 12, 2017 Office Action issued in U.S. Appl. No. 14/771,270.

Jan. 17, 2018 Office Action issued in Korean Patent Application No. 2016-7016521.

Feb. 15, 2018 Office Action issued in U.S. Appl. No. 15/119,778.

Jun. 23, 2017 Office Action issued in U.S. Appl. No. 14/384,298.

Oct. 17, 2017 Office Action issued in U.S. Appl. No. 14/384,298.

Apr. 2, 2018 Office Action issued in U.S. Appl. No. 14/384,298.

Aug. 13, 2018 Office Action issued in U.S. Appl. No. 14/384,298.

Sep. 5, 2019 Office Action issued in U.S. Appl. No. 14/384,298.

* cited by examiner

HIGH-STRENGTH STEEL SHEET AND METHOD FOR MANUFACTURING THE SAME

This application is a national stage of PCT/JP2014/005703, filed Nov. 13, 2014, which claims the benefit of priority to Japanese Application No. 2013-241539, filed Nov. 22, 2013. The entire contents of the prior applications are hereby incorporated by reference herein in their entirety.

TECHNICAL FIELD

This application relates to a high-strength steel sheet having excellent phosphatability and excellent corrosion resistance after electrodeposition coating has been performed, even in the case where the contents of Si and Mn are high and to a method for manufacturing the steel sheet.

BACKGROUND

Nowadays, from the viewpoint of an increase in the fuel efficiency of automobiles and the collision safety of automobiles, there is a growing demand for weight reduction and strengthening of automobile bodies by increasing the strength of a material for automobile bodies in order to decrease the thickness of the material. Therefore, the application of high-strength steel sheets to automobiles is promoted.

Generally, an automotive steel sheet is used in the painted state, and a chemical conversion treatment called phosphating is performed as a pretreatment for such painting. The chemical conversion treatment of a steel sheet is one of the important treatments for achieving corrosion resistance of the steel sheet after painting has been performed.

It is effective to add Si and Mn in order to increase the strength and the ductility of a steel sheet. However, when continuous annealing is performed, Si and Mn oxidize and form surface oxides selectively containing Si and Mn (such as $SiO_2$ and MnO, referred to as "selective surface oxides" hereinafter) in the outermost surface layer of the steel sheet even in a reducing atmosphere of $N_2$+$H_2$ gas in which oxidation of Fe does not occur (that is, oxidized Fe is reduced). Since such selective surface oxides inhibit the generation reaction of a chemical conversion coating when a chemical conversion treatment is performed, a micro region in which a chemical conversion coating is not formed (also referred to as a "lack of hiding" hereinafter) is formed, which results in a decrease in phosphatability.

Patent Literature 1 discloses an example of conventional techniques for increasing the phosphatability of a steel sheet containing Si and Mn in which an iron coating layer having a coating weight of 20 to 1500 mg/m$^2$ is formed on a steel sheet by using an electroplating method. However, in the case of this method, since additional electroplating equipment is needed, there are problems of an increase in the number of processes and an increase in cost.

In addition, in Patent Literature 2, phosphatability is increased by specifying the ratio of Mn to Si (Mn/Si). In Patent Literature 3, phosphatability is increased by adding Ni. However, since such effects depend on the contents of Si and Mn in a steel sheet, it is considered that further improvement is necessary in the case of a steel sheet having high Si and Mn contents.

Patent Literature 4 discloses a method in which, by controlling the dew point to be −25° C. to 0° C. when annealing is performed, an internal oxide layer including oxides containing Si is formed within 1 μm from the surface of a bare steel sheet in the depth direction so that Si-containing oxides constitute 80% or less of a length of 10 μm on the surface of a steel sheet. However, since the method according to Patent Literature 4 is based on the assumption that the zone in which the dew point is controlled is the whole furnace interior, it is difficult to control the dew point, and, as a result, it is difficult to realize a stable operation. In addition, in the case where annealing is performed while the dew point is unstably controlled, since there is a variation in the distribution of internal oxides formed in the steel sheet, there is concern that an irregularity in the result of a chemical conversion treatment or a lack of hiding may occur in whole or part in the longitudinal direction or width direction of the steel sheet. Moreover, even in the case where there is an increase in phosphatability, since Si-containing oxides exist immediately under a chemical conversion coating, there is a problem of poor corrosion resistance after electrodeposition coating has been performed.

Patent Literature 5 describes a method in which a steel sheet is heated to a temperature of 350° C. to 650° C. in an oxidizing atmosphere in order to form an oxide film on the surface of the steel sheet, then heated to the recrystallization temperature in a reducing atmosphere, and then cooled. However, in the case of this method, since the thickness of the oxide film formed on the surface of the steel sheet varies depending on an oxidizing method, there is a case where oxidizing does not sufficiently progress or where the thickness of oxide film formed is so thick that the oxide film is retained or flaking of the oxide film occurs when annealing is subsequently performed in a reducing atmosphere, which may result in a decrease in surface quality. In addition, in the EXAMPLES of Patent Literature 5, a technique in which oxidation is performed in atmospheric air is described. However, in the case of oxidation in atmospheric air, since a thick oxide layer is formed, there is a problem, for example, in that it is difficult to subsequently perform reduction or in that a reducing atmosphere having a high hydrogen concentration is needed.

Patent Literature 6 describes a method in which a cold-rolled steel sheet containing, by mass %, 0.1% or more of Si and/or 1.0% or more of Mn is heated to a temperature of 400° C. or higher in an iron-oxidizing atmosphere in order to form an oxide film on the surface of the steel sheet, and the oxide film on the surface of the steel sheet is subsequently reduced in an iron-reducing atmosphere. Specifically, by oxidizing Fe on the surface of a steel sheet at a temperature of 400° C. or higher by using direct fire burners in an atmosphere having an air ratio of 0.93 or more and 1.10 or less, and by then annealing the steel sheet in an atmosphere of $N_2$+$H_2$ gas for reducing Fe oxide, the oxidation of Si on the outermost surface, which decreases phosphatability, is inhibited so that an Fe oxide layer is formed on the outermost surface. Although the heating temperature of the direct fire burners is not specifically described in Patent Literature 6, it is considered that, in the case where the Si content is high (about 0.6% or more), since Si is more likely to be oxidized than Fe, there is an increase in the amount of Si oxidized, which results in the oxidation of Fe being inhibited or results in a decrease in the amount of Fe oxidized. As a result, the layer of reduced Fe is insufficiently formed on the surface after reduction has been performed, or $SiO_2$ exists on the surface of the steel sheet after reduction has been performed, which may result in a lack of hiding occurring in a chemical conversion coating.

CITATION LIST

Patent Literature

[PTL 1] Japanese Unexamined Patent Application Publication No. 5-320952

[PTL 2] Japanese Unexamined Patent Application Publication No. 2004-323969

[PTL 3] Japanese Unexamined Patent Application Publication No. 6-10096

[PTL 4] Japanese Unexamined Patent Application Publication No. 2003-113441

[PTL 5] Japanese Unexamined Patent Application Publication No. 55-145122

[PTL 6] Japanese Unexamined Patent Application Publication No. 2006-45615

SUMMARY

Technical Problem

The disclosed embodiments have been completed in view of the situation described above, and an object of the disclosed embodiments is to provide a high-strength steel sheet having excellent phosphatability and excellent corrosion resistance after electrodeposition coating has been performed, even in the case where the contents of Si and Mn are high and to provide a method for manufacturing the steel sheet.

Solution to Problem

Conventionally, in the case of a steel sheet containing oxidizable chemical elements such as Si and Mn, the internal oxidation of a steel sheet has been actively performed in order to increase phosphatability. However, at the same time, an irregularity or a lack of hiding in the result of a chemical conversion treatment occurs due to internal oxidation, or there is a decrease in corrosion resistance after electrodeposition coating has been performed. Therefore, investigations regarding a method for solving the problems were conducted by using a new method independent of conventional thought, and, as a result, it was found that, by appropriately controlling heating rate, atmosphere, and temperature in an annealing process in order to inhibit the formation of internal oxides in the surface layer of a steel sheet, it is possible to achieve excellent phosphatability and increased corrosion resistance after electrodeposition coating has been performed. Specifically, when continuous annealing is performed, a heating process is performed at a heating rate of 7° C./sec. or more in a temperature range in the annealing furnace of 450° C. or higher and A° C. or lower (A: 500≤A≤600), the maximum end-point temperature of a steel sheet in the annealing furnace is controlled to be 600° C. or higher and 700° C. or lower, the traveling time of the steel sheet in a steel sheet temperature range of 600° C. or higher and 700° C. or lower is controlled to be 30 seconds or more and 10 minutes or less, and the dew point of the atmosphere in a steel sheet temperature range of 600° C. or higher and 700° C. or lower is controlled to be −40° C. or lower, and then a chemical conversion treatment is performed. By performing a heating process at a heating rate of 7° C./sec. or more in a temperature range in the annealing furnace of 450° C. or higher and A° C. or lower (A: 500≤A≤600), by controlling the maximum end-point temperature of a steel sheet in the annealing furnace to be 600° C. or higher and 700° C. or lower, and by controlling the dew point of the atmosphere in a steel sheet temperature range of 600° C. or higher and 700° C. or lower to be −40° C. or lower, since oxygen potential at the interface between the steel sheet and the atmosphere is decreased so that the internal oxidation is inhibited as much as possible, the selective surface diffusion and oxidation (hereinafter, referred to as "surface concentration") of, for example, Si and Mn is inhibited.

By controlling heating rate and dew point and temperature in an atmosphere in specified regions, it is possible to prevent internal oxides from forming, to inhibit surface concentration as much as possible, and to obtain a high-strength steel sheet having excellent phosphatability and excellent corrosion resistance after electrodeposition coating has been performed. Here, "having excellent phosphatability" refers to a case where a steel sheet has a surface appearance without a lack of hiding or an irregularity in the result of a chemical conversion treatment.

In the case of a high-strength steel sheet obtained by using the method described above, the formation of oxides of Fe, Si, Mn, Al, and P, and, in addition, B, Nb, Ti, Cr, Mo, Cu, Ni, Sn, Sb, Ta, W, and V is inhibited in the surface layer of the steel sheet within 100 μm of the surface of the steel sheet so that the total amount of the oxides formed is limited to less than 0.030 $g/m^2$ per side. Therefore, excellent phosphatability is achieved and there is a significant increase in corrosion resistance after electrodeposition coating has been performed.

The disclosed embodiments have been completed on the basis of the findings described above and is characterized as follows.

[1] A method for manufacturing a high-strength steel sheet, the method including, when a steel sheet having a chemical composition containing, by mass %, C: 0.03% or more and 0.35% or less, Si: 0.01% or more and 0.50% or less, Mn: 3.6% or more and 8.0% or less, Al: 0.01% or more and 1.0% or less, P: 0.10% or less, S: 0.010% or less, and the balance being Fe and inevitable impurities is annealed by using a continuous annealing method, performing a heating process at a heating rate of 7° C./sec. or more in a temperature range in the annealing furnace of 450° C. or higher and A° C. or lower (A: 500≤A≤600), controlling the maximum end-point temperature of a steel sheet in the annealing furnace to be 600° C. or higher and 700° C. or lower, controlling the traveling time of the steel sheet in a steel sheet temperature range of 600° C. or higher and 700° C. or lower to be 30 seconds or more and 10 minutes or less, and controlling the dew point of the atmosphere in a steel sheet temperature range of 600° C. or higher and 700° C. or lower to be −40° C. or lower.

[2] The method for manufacturing a high-strength steel sheet according to item [1] above, the steel sheet having the chemical composition further containing, by mass %, one or more chemical elements selected from among B: 0.001% or more and 0.005% or less, Nb: 0.005% or more and 0.05% or less, Ti: 0.005% or more and 0.05% or less, Cr: 0.001% or more and 1.0% or less, Mo: 0.05% or more and 1.0% or less, Cu: 0.05% or more and 1.0% or less, Ni: 0.05% or more and 1.0% or less, Sn: 0.001% or more and 0.20% or less, Sb: 0.001% or more and 0.20% or less, Ta: 0.001% or more and 0.10% or less, W: 0.001% or more and 0.10% or less, and V: 0.001% or more and 0.10% or less.

[3] The method for manufacturing a high-strength steel sheet according to item [1] or [2] above, the method further including performing electrolytic pickling in an aqueous solution containing sulfuric acid.

[4] A high-strength steel sheet, the steel sheet being manufactured by using the method according to any one of items [1] to [3] above, in which the total amount of oxides of Fe, Si, Mn, Al, P, B, Nb, Ti, Cr, Mo, Cu, Ni, Sn, Sb, Ta, W, and V formed in the surface layer of the steel sheet within 100 μm of the surface of the steel sheet is less than 0.030 $g/m^2$ per side.

Here, in embodiments, a "high-strength steel sheet" refers to a steel sheet having a tensile strength TS of 590 MPa or more. In addition, the meaning of the "high-strength steel sheet" according to the disclosed embodiments includes both a hot-rolled steel sheet and a cold-rolled steel sheet.

Advantageous Effects

According to the disclosed embodiments, it is possible to obtain a high-strength steel sheet having excellent phosphatability and excellent corrosion resistance after electrodeposition coating has been performed, even in the case where the contents of Si and Mn are high.

DETAILED DESCRIPTION

Hereafter, the disclosed embodiments will be described in detail. Here, in the description below, the contents of the constituent chemical elements of the chemical composition of steel will be expressed in units of "mass %", and "mass %" will be simply represented by "%", unless otherwise noted.

First, annealing atmosphere conditions, which are the most important requirements in the disclosed embodiments and which determine the structure of the surface of a steel sheet, will be described. In order to achieve satisfactory corrosion resistance in the case of a high-strength steel sheet which is manufactured by adding a large amount of Si and Mn in steel, it is required to control the amount of the internal oxides, which exist in the surface layer of the steel sheet, and from which corrosion may originate, to be as small as possible. On the other hand, although it is possible to increase phosphatability by promoting the internal oxidation of Si and Mn, doing so conversely causes a decrease in corrosion resistance. Therefore, it is necessary to increase corrosion resistance by inhibiting internal oxidation while maintaining good phosphatability by using a method other than that in which the internal oxidation of Si and Mn is promoted. From the results of diligent investigations that were conducted, in embodiments, by decreasing oxygen potential in an annealing process in order to achieve good phosphatability, the activity of, for example, Si and Mn in the surface layer of the steel sheet, which are oxidizable chemical elements, is decreased so that the external oxidation of these chemical element is inhibited, which results in an increase in phosphatability. Moreover, since the occurrence of internal oxidation in the surface layer of a steel sheet is also inhibited, there is an increase in corrosion resistance after electrodeposition coating has been performed.

Such effects are realized, when annealing is performed in continuous annealing equipment, by performing a heating process at a heating rate of 7° C./sec. or more in a temperature range in the annealing furnace of 450° C. or higher and A° C. or lower (A: 500≤A≤600), controlling the maximum end-point temperature of a steel sheet in the annealing furnace to be 600° C. or higher and 700° C. or lower, controlling the traveling time of the steel sheet in a steel sheet temperature range of 600° C. or higher and 700° C. or lower to be 30 seconds or more and 10 minutes or less, and controlling the dew point of the atmosphere in a steel sheet temperature range of 600° C. or higher and 700° C. or lower to be −40° C. or lower.

By controlling the heating rate to be 7° C./sec. or more in a temperature range in the annealing furnace of 450° C. or higher and A° C. or lower (A: 500≤A≤600), it is possible to inhibit the formation of surface-concentration matter as much as possible. Moreover, by controlling the dew point of the atmosphere in a steel sheet temperature range of 600° C. or higher and 700° C. or lower to be −40° C. or lower, since it is possible to decrease the oxygen potential of the interface between the steel sheet and the atmosphere, it is possible to inhibit the selective surface diffusion and surface concentration of, for example, Si and Mn without the occurrence of internal oxidation. As a result, in the disclosed embodiments, it is possible to achieve excellent phosphatability without a lack of hiding or irregularity and increased corrosion resistance after electrodeposition coating has been performed.

The reason why the temperature range in which the heating rate is controlled is a temperature range of 450° C. or higher is as follows. The level of surface concentration or internal oxidation occurring in a temperature range lower than 450° C. is not high enough to cause, for example, a lack of hiding, irregularity, or a decrease in corrosion resistance having a negative effect. Therefore, the temperature range is set to be a temperature range of 450° C. or higher in which the effect of the disclosed embodiments is realized.

In addition, the reason why the upper limit temperature A is set to be within the range expressed by 500≤A≤600 is as follows. First, in a temperature range lower than 500° C., since the time for which the heating rate is controlled to be 7° C./sec. or more is short, the effect of the disclosed embodiments is insufficiently realized. Even in the case where the dew point is lowered to −40° C. or lower, there is an insufficient effect of inhibiting surface concentration. Therefore, A is set to be 500° C. or higher. In addition, in a temperature range higher than 600° C., although there is no problem with the effect of the disclosed embodiments, there is a disadvantage from the viewpoint of the deterioration of devices (such as rolls) in the annealing furnace and an increase in cost. Therefore, A is set to be 600° C. or lower.

The reason why the heating rate is controlled to be 7° C./sec. or more is as follows. The effect of inhibiting surface concentration is realized in the case where the heating rate is 7° C./sec. or more. There is no particular limitation on the upper limit of the heating rate. Here, in the case where the heating rate is 500° C./sec. or more, since the effect becomes saturated, there is an economic disadvantage. Therefore, it is preferable that the heating rate be 500° C./sec. or less. It is possible to control the heating rate to be 7° C./sec. or more by placing, for example, an induction heater in the region of the annealing furnace where the temperature of the steel sheet is 450° C. or higher and A° C. or lower.

The reason why the maximum end-point temperature of the steel sheet in the annealing furnace is controlled to be 600° C. or higher and 700° C. or lower is as follows. In a temperature range lower than 600° C., it is not possible to achieve good material properties. Therefore, the temperature range in which the effect of the disclosed embodiments is realized is set to be 600° C. or higher. On the other hand, in a temperature range higher than 700° C., since surface concentration becomes noticeable, there is a decrease in phosphatability. Moreover, from the viewpoint of material properties, in a temperature range higher than 700° C., the effect of a strength-ductility balance becomes saturated.

Therefore, the maximum end-point temperature of the steel sheet is set to be 600° C. or higher and 700° C. or lower.

Hereafter, the reason why the traveling time of the steel sheet in a steel sheet temperature range of 600° C. or higher and 700° C. or lower is controlled to be 30 seconds or more and 10 minutes or less is as follows. In the case where the traveling time is less than 30 seconds, it is not possible to achieve the target material properties (tensile strength TS and elongation El). On the other hand, in the case where the traveling time is more than 10 minutes, the effect of a strength-ductility balance becomes saturated.

The reason why the dew point of the atmosphere in a steel sheet temperature range of 600° C. or higher and 700° C. or lower is controlled to be −40° C. or lower is as follows. The effect of inhibiting surface concentration is realized in the case where the dew point is −40° C. or lower. There is no particular limit on the lower limit of the dew point. Here, in the case where the dew point is lower than −80° C., since the effect becomes saturated, there is an economic disadvantage. Therefore, it is preferable that the dew point be −80° C. or higher.

Hereafter, the chemical composition of the high-strength steel sheet according to the disclosed embodiments will be described.

C: 0.03% or more and 0.35% or less

C increases workability by forming, for example, martensite as a steel microstructure. In order to realize such an effect, it is necessary that the C content be 0.03% or more. On the other hand, in the case where the C content is more than 0.35%, there is a decrease in elongation due to an excessive increase in strength, which results in a decrease in workability. Therefore, the C content is set to be 0.03% or more and 0.35% or less.

Si: 0.01% or more and 0.50% or less Si is a chemical element which is effective for achieving good material properties by increasing the strength of steel. However, since Si, which is an oxidizable chemical element, is disadvantageous for a chemical conversion treatment, adding Si should be avoided as much as possible. In addition, since Si is inevitably contained in steel in an amount of about 0.01%, there is an increase in cost in order to decrease the Si content to be less than 0.01%. Therefore, the lower limit of the Si content is set to be 0.01%. On the other hand, in the case where the Si content is more than 0.50%, the effect of increasing the strength and elongation of steel becomes saturated, and there is a decrease in phosphatability. Therefore, the Si content is set to be 0.01% or more and 0.50% or less.

Mn: 3.6% or more and 8.0% or less

Mn is a chemical element which is effective for increasing the strength of steel. In order to achieve satisfactory mechanical properties and strength, it is necessary that the Mn content be 3.6% or more. On the other hand, in the case where the Mn content is more than 8.0%, it is difficult to achieve satisfactory phosphatability and a satisfactory strength-ductility balance, and there is an economic disadvantage. Therefore, the Mn content is set to be 3.6% or more and 8.0% or less.

Al: 0.01% or more and 1.0% or less

Al is added in order to deoxidize molten steel. However, in the case where the Al content is less than 0.01%, such an object is not realized. The effect of deoxidizing molten steel is realized in the case where the Al content is 0.01% or more. On the other hand, in the case where the Al content is more than 1.0%, there is an increase in cost, and it is difficult to increase phosphatability due to an increase in the amount of surface concentration of Al. Therefore, the Al content is set to be 0.01% or more and 1.0% or less.

P: 0.10% or less

P is one of the chemical elements which are inevitably contained. In the case where the P content is more than 0.10%, there is a decrease in weldability, and it is difficult to increase phosphatability even by using the disclosed embodiments due to a significant decrease in phosphatability. Therefore, the P content is set to be 0.10% or less. Here, there is concern that there may be an increase in cost in order to control the P content to be less than 0.005%. Therefore, it is preferable that the P content be 0.005% or more.

S: 0.010% or less

S is one of the chemical elements which are inevitably contained. Therefore, there is no particular limitation on the lower limit of the S content. However, in the case where the S content is large, there is a decrease in weldability and corrosion resistance. Therefore, the S content is set to be 0.010% or less.

Here, one or more chemical elements selected from among B: 0.001% or more and 0.005% or less, Nb: 0.005% or more and 0.05% or less, Ti: 0.005% or more and 0.05% or less, Cr: 0.001% or more and 1.0% or less, Mo: 0.05% or more and 1.0% or less, Cu: 0.05% or more and 1.0% or less, Ni: 0.05% or more and 1.0% or less, Sn: 0.001% or more and 0.20% or less, Sb: 0.001% or more and 0.20% or less, Ta: 0.001% or more and 0.10% or less, W: 0.001% or more and 0.10% or less, and V: 0.001% or more and 0.10% or less may be added as needed in order to further improve surface quality and a strength-ductility balance. In the case where these chemical elements are added, the reasons for the limitations on the appropriate amounts of these chemical elements added are as follows.

B: 0.001% or more and 0.005% or less

In the case where the B content is less than 0.001%, it is difficult to realize the effect of increasing hardenability. On the other hand, in the case where the B content is more than 0.005%, there is a decrease in phosphatability. Therefore, in the case where B is added, the B content is set to be 0.001% or more and 0.005% or less. However, in the case where it is considered that it is not necessary to add B in order to improve mechanical properties, it is not necessary to add B.

Nb: 0.005% or more and 0.05% or less

In the case where the Nb content is less than 0.005%, it is difficult to realize the effect of controlling strength. On the other hand, in the case where the Nb content is more than 0.05%, there is an increase in cost. Therefore, in the case where Nb is added, the Nb content is set to be 0.005% or more and 0.05% or less.

Ti: 0.005% or more and 0.05% or less

In the case where the Ti content is less than 0.005%, it is difficult to realize the effect of controlling strength. On the other hand, in the case where the Ti content is more than 0.05%, there is a decrease in phosphatability. Therefore, in the case where Ti is added, the Ti content is set to be 0.005% or more and 0.05% or less.

Cr: 0.001% or more and 1.0% or less

In the case where the Cr content is less than 0.001%, it is difficult to realize the effect of hardenability. On the other hand, in the case where the Cr content is more than 1.0%, since Cr undergoes surface concentration, there is a decrease in weldability. Therefore, in the case where Cr is added, the Cr content is set to be 0.001% or more and 1.0% or less.

Mo: 0.05% or more and 1.0% or less

In the case where the Mo content is less than 0.05%, it is difficult to realize the effect of controlling strength. On the other hand, in the case where the Mo content is more than 1.0%, there is an increase in cost. Therefore, in the case where Mo is added, the Mo content is set to be 0.05% or more and 1.0% or less.

Cu: 0.05% or more and 1.0% or less

In the case where the Cu content is less than 0.05%, it is difficult to realize the effect of promoting the formation of a retained γ phase. On the other hand, in the case where the Cu content is more than 1.0%, there is an increase in cost. Therefore, in the case where Cu is added, the Cu content is set to be 0.05% or more and 1.0% or less.

Ni: 0.05% or more and 1.0% or less

In the case where the Ni content is less than 0.05%, it is difficult to realize the effect of promoting the formation of a retained γ phase. On the other hand, in the case where the Ni content is more than 1.0%, there is an increase in cost. Therefore, in the case where Ni is added, the Ni content is set to be 0.05% or more and 1.0% or less.

Sn: 0.001% or more and 0.20% or less and Sb: 0.001% or more and 0.20% or less

Sn and Sb may be added in order to inhibit the nitration or oxidation of the surface of a steel sheet or the decarburization due to oxidation of a region within several tens of micrometers of the surface of a steel sheet. By inhibiting nitration and oxidation, a decrease in the amount of martensite formed in the surface of a steel sheet is prevented and there is an improvement in fatigue characteristic and surface quality. From the viewpoint described above, in the case where Sn and/or Sb are added, each of the contents of these chemical elements is set to be 0.001% or more. In addition, since there is a decrease in toughness in the case where any one of the contents of these chemical elements is more than 0.20%, it is preferable that each of the contents of these chemical elements be 0.20% or less.

Ta: 0.001% or more and 0.10% or less

Ta contributes to an increase in strength by combining with C and N to form carbides and carbonitrides and to an increase in yield ratio (YR). Moreover, since Ta is effective for decreasing the grain diameter of the microstructure of a hot-rolled steel sheet, there is a decrease in the ferrite grain diameter of the steel sheet due to such an effect after cold rolling or annealing has been performed. In addition, by adding Ta, since there is an increase in the amount of C segregated at the grain boundaries due to an increase in the area of the grain boundaries, it is possible to achieve a large amount of bake hardening (BH amount). From such viewpoints, Ta may be added in an amount of 0.001% or more. On the other hand, in the case where the Ta content is more than 0.10%, there is an increase in raw material costs, and there is a possibility in that the formation of martensite is obstructed in a cooling process following an annealing process. Moreover, there is a case where, since TaC precipitated in a hot-rolled steel sheet increases resistance to deformation when cold rolling is performed, it may be difficult to stably manufacture steel sheets in a practical line. Therefore, in the case where Ta is added, the Ta content is set to be 0.001% or more and 0.10% or less.

W: 0.001% or more and 0.10% or less and V: 0.001% or more and 0.10% or less

W and V, which are chemical elements effective for increasing the strength of steel through a precipitation effect by forming carbonitrides, may be added as needed. In the case where W and/or V are added, such an effect is realized when each of the contents of these chemical elements is 0.001% or more. On the other hand, in the case where any one of the contents of these chemical elements is more than 0.10%, there is a decrease in ductility due to an excessive increase in strength. Therefore, in the case where W and/or V are added, each of the contents of these chemical elements is set to be 0.001% or more and 0.10% or less.

The remaining constituent chemical elements other than those described above are Fe and inevitable impurities. There is no negative effect on the disclosed embodiments, even in the case where chemical elements other than those described above are added, and the upper limit of the content is set to be 0.10%.

Hereafter, the method for manufacturing the high-strength steel sheet according to the disclosed embodiments and the reasons for the limitations on the method will be described.

Steel having the chemical composition described above is subjected to hot rolling and then to cold rolling in order to obtain a steel sheet, and, subsequently, annealing is performed in continuous annealing equipment. In addition, it is preferable that electrolytic pickling be performed in an aqueous solution containing sulfuric acid. Subsequently, a chemical conversion treatment is performed. Here, at this time, in the disclosed embodiments, a heating process is performed at a heating rate of 7° C./sec. or more in a temperature range in the annealing furnace of 450° C. or higher and A° C. or lower (A: $500 \leq A \leq 600$), the maximum end-point temperature of a steel sheet in the annealing furnace is controlled to be 600° C. or higher and 700° C. or lower, the traveling time of the steel sheet in a steel sheet temperature range of 600° C. or higher and 700° C. or lower is controlled to be 30 seconds or more and 10 minutes or less, and the dew point of the atmosphere in the steel sheet temperature range is controlled to be −40° C. or lower. These are the most important requirements in the disclosed embodiments. Here, in the process described above, annealing may be performed without performing cold rolling after hot rolling has been performed.

Hot Rolling

Hot rolling may be performed under ordinarily used conditions.

Pickling

It is preferable that pickling be performed after hot rolling has been performed. After having removing black scale formed on the surface of the steel sheet in a pickling process, cold rolling is performed. Here, there is no particular limitation on pickling conditions.

Cold Rolling

It is preferable that cold rolling be performed with a rolling reduction ratio of 40% or more and 80% or less. In the case where the rolling reduction is less than 40%, since there is a decrease in recrystallization temperature, mechanical properties tend to deteriorate. On the other hand, in the case where the rolling reduction is more than 80%, there is an increase in rolling costs because a high-strength steel sheet is rolled, and there may be a decrease in phosphatability due to an increase in the amount of surface concentration when annealing is performed.

The cold-rolled steel sheet or the hot-rolled steel sheet is subjected to continuous annealing and then subjected to a chemical conversion treatment.

In the annealing furnace, a heating process is performed in a heating zone in the former part of the furnace in order to heat the steel sheet to a specified temperature, and a soaking process is performed in a soaking zone in the latter part of the furnace in order to hold the steel sheet at a specified temperature for a specified time.

As described above, in the disclosed embodiments, when annealing is performed, a heating process is performed at a heating rate of 7° C./sec. or more in a temperature range in the annealing furnace of 450° C. or higher and A° C. or lower (A: $500 \leq A \leq 600$), the maximum end-point temperature of a steel sheet in the annealing furnace is controlled to be 600° C. or higher and 700° C. or lower, the traveling time of the steel sheet in a steel sheet temperature range of 600° C. or higher and 700° C. or lower is controlled to be 30 seconds or more and 10 minutes or less, and the dew point of the atmosphere in the steel sheet temperature range is controlled to be −40° C. or lower. Since an ordinary dew point is higher than −40° C., it is possible to achieve a dew point of −40° C. or lower by removing the water by performing absorption removal in the furnace by using a dehumidification device or an absorbing agent.

The chemical composition of the gas in the annealing furnace contains nitrogen, hydrogen, and inevitable impurities. Other constituent gases may be contained as long as the effect of the disclosed embodiments is not decreased.

In the case where the hydrogen concentration is less than 1 vol %, since it is not possible to realize an activation effect due to reduction, there may be a decrease in phosphatability. There is no particular limitation on the upper limit of the hydrogen concentration. However, in the case where the hydrogen concentration is more than 50 vol %, there is an increase in cost, and the effect becomes saturated. Therefore, it is preferable that the hydrogen concentration be 1 vol % or more and 50 vol % or less, or more preferably 5 vol % or more and 30 vol % or less. In addition, the balance consists of $N_2$ and inevitable impurities. As long as the effect of the disclosed embodiments is not decreased, other constituent gases such as $H_2O$, $CO_2$, and CO may be contained.

Moreover, after cooling from the temperature range of 600° C. or higher and 700° C. or lower has been performed, quenching or tempering may be performed as needed. There is no particular limitation on what conditions are used for quenching and tempering. Here, it is preferable that tempering be performed at a temperature of 150° C. or higher and 400° C. or lower. There is a tendency for elongation to decrease in the case where tempering temperature is lower than 150° C., and there is a tendency for hardness to decrease in the case where tempering temperature is higher than 400° C.

In the disclosed embodiments, it is possible to achieve good phosphatability, even in the case where electrolytic pickling is not performed. In the disclosed embodiments, in order to achieve further increased phosphatability by removing a small amount of surface-concentration matter which is inevitably formed when annealing is performed, it is preferable that electrolytic pickling be performed in an aqueous solution containing sulfuric acid after continuous annealing has been performed.

There is no particular limitation on what kind of pickling solution is used for electrolytic pickling. However, nitric acid or hydrofluoric acid is not preferable, because it is necessary to carefully handle such kinds of acids because such kinds of acids have a strong corrosive effect on the annealing equipment. In addition, hydrochloric acid is not preferable, because chlorine gas may be generated at the cathode. Therefore, it is preferable to use sulfuric acid in consideration of corrosiveness and environment. It is preferable that the sulfuric acid concentration be 5 mass % or more and 20 mass % or less. In the case where the sulfuric acid concentration is less than 5 mass %, since there is a decrease in electrical conductivity, there may be an increase in power load due to an increase in bath voltage when an electrolytic reaction occurs. On the other hand, in the case where the sulfuric acid concentration is more than 20 mass %, since there is an increase in loss due to drag-out, there is a cost problem.

There is no particular limitation on what condition is used for electrolytic pickling. In the disclosed embodiments, in order to efficiently remove oxides of Si and Mn, which are inevitably formed and undergo surface concentration after annealing has been performed, it is preferable that alternate current electrolysis be performed with a current density of 1 Ampere/$dm^2$ or more. The reason why alternate current electrolysis is performed is because, in the case where the steel sheet is held at the cathode, there is an insufficient effect of pickling, and, on the other hand, in the case where the steel sheet is held at the anode, since Fe which is eluted when electrolysis is performed is accumulated in the pickling solution, there is an increase in Fe concentration in the pickling solution, which results in problems such as dry stain due to the adhesion of the solution to the surface of the steel sheet.

It is preferable that the temperature of the electrolytic solution be 40° C. or higher and 70° C. or lower. Since there is an increase in bath temperature due to the heat generation caused by continuous electrolysis, there is a case where it is difficult to keep the temperature lower than 40° C. In addition, from the viewpoint of the durability of the lining of the electrolysis bath, it is not preferable that the temperature be higher than 70° C. Here, since there is an insufficient pickling effect in the case where the temperature is lower than 40° C., it is preferable that the temperature be 40° C. or higher.

As described above, the high-strength steel sheet according to the disclosed embodiments is obtained, and the steel sheet is characterized as having the structure described below in the surface layer thereof.

In the surface layer of the steel sheet within 100 μm of the surface of the steel sheet, the total amount of the oxides formed of Fe, Si, Mn, Al, P, B, Nb, Ti, Cr, Mo, Cu, Ni, Sn, Sb, Ta, W, and V is limited to less than 0.030 g/$m^2$ per side. In the case of a steel sheet which is manufactured by adding Si and a large amount of Mn in steel, it is required not only to inhibit an irregularity and a lack of hiding in the result of a chemical conversion treatment by controlling the amount of internal oxides in the surface layer of the steel sheet to be as small as possible but also to inhibit corrosion and cracking when intense working is performed. Therefore, in the disclosed embodiments, first, in order to achieve good phosphatability, the activity of, for example, Si and Mn, which are oxidizable chemical elements, in the surface layer of the steel sheet is decreased by decreasing the oxygen potential in an annealing process. Then, the external oxidation of such chemical elements is inhibited, and the occurrence of internal oxidation in the surface layer of a steel sheet is also inhibited. As a result, it is possible not only to achieve good phosphatability but also to increase corrosion resistance and workability after electrodeposition coating has been performed. Such effects are realized by limiting the total amount of oxides of Fe, Si, Mn, Al, P, B, Nb, Ti, Cr, Mo, Cu, Ni, Sn, Sb, Ta, W, and V formed in the surface layer of the steel sheet within 100 μm of the surface of the steel sheet to be less than 0.030 g/$m^2$ per side. In the case where the total amount of the oxides formed (hereinafter, referred to as the "amount of internal oxidation") is 0.030 g/$m^2$ or more, there is a decrease in corrosion resistance and workability, and a lack of hiding and an irregularity in the result of a chemical conversion treatment occur. Here, since the effect of increasing corrosion resistance and workability becomes saturated in the case where the amount of internal oxidation is limited to be less than 0.0001 g/$m^2$, it is preferable that the lower limit of the amount of internal oxidation be 0.0001 g/$m^2$ or more.

EXAMPLES

Hereafter, the disclosed embodiments will be specifically described on the basis of examples.

By pickling hot-rolled steel sheets having the steel chemical composition given in Table 1 in order to remove black scale, by then performing cold rolling on the pickled steel sheets under the conditions given in Table 2, cold-rolled steel sheets having a thickness of 1.0 mm were obtained. Here, some of the steel sheets were not subjected to cold rolling and left as hot-rolled steel sheets (having a thickness of 2.0 mm) from which black scale had been removed.

TABLE 1

(mass %)

| Steel Code | C | Si | Mn | Al | P | S | Cr | Mo | B | Nb | Cu | Ni | Ti | Sn | Sb | Ta | W | V |
|---|---|---|---|---|---|---|---|---|---|---|---|---|---|---|---|---|---|---|
| A | 0.11 | 0.02 | 4.4 | 0.02 | 0.01 | 0.003 | — | — | — | — | — | — | — | — | — | — | — | — |
| B | 0.02 | 0.02 | 4.5 | 0.03 | 0.01 | 0.003 | — | — | — | — | — | — | — | — | — | — | — | — |
| C | 0.36 | 0.02 | 4.8 | 0.03 | 0.01 | 0.003 | — | — | — | — | — | — | — | — | — | — | — | — |
| D | 0.13 | 0.11 | 4.6 | 0.02 | 0.01 | 0.003 | — | — | — | — | — | — | — | — | — | — | — | — |
| E | 0.12 | 0.31 | 4.7 | 0.03 | 0.01 | 0.003 | — | — | — | — | — | — | — | — | — | — | — | — |
| F | 0.11 | 0.49 | 4.5 | 0.03 | 0.01 | 0.003 | — | — | — | — | — | — | — | — | — | — | — | — |
| G | 0.12 | 0.02 | 3.7 | 0.03 | 0.01 | 0.003 | — | — | — | — | — | — | — | — | — | — | — | — |
| H | 0.11 | 0.03 | 6.2 | 0.02 | 0.01 | 0.003 | — | — | — | — | — | — | — | — | — | — | — | — |
| I | 0.11 | 0.02 | 8.1 | 0.03 | 0.01 | 0.003 | — | — | — | — | — | — | — | — | — | — | — | — |
| J | 0.12 | 0.02 | 4.6 | 0.29 | 0.01 | 0.003 | — | — | — | — | — | — | — | — | — | — | — | — |
| K | 0.11 | 0.03 | 4.5 | 0.99 | 0.01 | 0.003 | — | — | — | — | — | — | — | — | — | — | — | — |
| L | 0.12 | 0.02 | 4.6 | 0.02 | 0.04 | 0.003 | — | — | — | — | — | — | — | — | — | — | — | — |
| M | 0.11 | 0.03 | 4.4 | 0.03 | 0.09 | 0.003 | — | — | — | — | — | — | — | — | — | — | — | — |
| N | 0.12 | 0.03 | 4.6 | 0.03 | 0.01 | 0.003 | — | — | — | — | — | — | — | — | — | — | — | — |
| O | 0.12 | 0.02 | 4.7 | 0.02 | 0.01 | 0.003 | 0.7 | — | — | — | — | — | — | — | — | — | — | — |
| P | 0.11 | 0.03 | 4.6 | 0.02 | 0.01 | 0.003 | — | 0.2 | — | — | — | — | — | — | — | — | — | — |
| Q | 0.12 | 0.02 | 4.6 | 0.03 | 0.01 | 0.003 | — | — | 0.002 | — | — | — | — | — | — | — | — | — |
| R | 0.11 | 0.03 | 4.5 | 0.04 | 0.01 | 0.003 | — | — | 0.002 | 0.02 | — | — | — | — | — | — | — | — |
| S | 0.12 | 0.02 | 4.6 | 0.02 | 0.01 | 0.003 | — | 0.2 | — | — | 0.2 | 0.1 | — | — | — | — | — | — |
| T | 0.12 | 0.03 | 4.7 | 0.03 | 0.01 | 0.003 | — | — | 0.002 | — | — | — | 0.01 | — | — | — | — | — |
| U | 0.11 | 0.02 | 4.7 | 0.04 | 0.01 | 0.003 | — | — | — | — | — | — | 0.04 | — | — | — | — | — |
| U1 | 0.12 | 0.02 | 4.5 | 0.02 | 0.01 | 0.003 | — | — | — | — | — | — | — | 0.04 | — | — | — | — |
| U2 | 0.11 | 0.03 | 4.6 | 0.03 | 0.01 | 0.003 | — | — | — | — | — | — | — | — | 0.03 | — | — | — |
| U3 | 0.12 | 0.03 | 4.5 | 0.03 | 0.01 | 0.003 | — | — | — | — | — | — | — | — | — | 0.02 | — | — |
| U4 | 0.11 | 0.03 | 4.6 | 0.02 | 0.01 | 0.003 | — | — | — | — | — | — | — | — | — | — | 0.02 | — |
| U5 | 0.12 | 0.03 | 4.7 | 0.02 | 0.01 | 0.003 | — | — | — | — | — | — | — | — | — | — | — | 0.02 |
| XA | 0.02 | 0.03 | 4.5 | 0.03 | 0.01 | 0.003 | — | — | — | — | — | — | — | — | — | — | — | — |
| XB | 0.36 | 0.02 | 4.6 | 0.03 | 0.01 | 0.003 | — | — | — | — | — | — | — | — | — | — | — | — |
| XC | 0.11 | 0.59 | 4.5 | 0.02 | 0.01 | 0.003 | — | — | — | — | — | — | — | — | — | — | — | — |
| XD | 0.12 | 0.02 | 3.5 | 0.03 | 0.01 | 0.003 | — | — | — | — | — | — | — | — | — | — | — | — |
| XE | 0.12 | 0.02 | 4.5 | 1.10 | 0.01 | 0.003 | — | — | — | — | — | — | — | — | — | — | — | — |
| XF | 0.11 | 0.03 | 4.6 | 0.03 | 0.11 | 0.003 | — | — | — | — | — | — | — | — | — | — | — | — |
| XG | 0.12 | 0.02 | 4.6 | 0.02 | 0.01 | 0.020 | — | — | — | — | — | — | — | — | — | — | — | — |

An underlined portion indicates a value out of the range according to the disclosed embodiments.

Subsequently, the cold-rolled steel sheets obtained as described above were charged into continuous annealing equipment. In the annealing equipment, as indicated in Table 2, the heating rate in a steel sheet temperature range in the annealing furnace of 450° C. or higher and A° C. or lower (A: 500≤A≤600), the traveling time of the steel sheet and the dew point in a temperature range of 600° C. or higher and 700° C. or lower, and the maximum end-point temperature of the steel sheet were controlled while the steel sheets were passed through the annealing equipment in order to perform annealing, then, water quenching was performed, and, then, tempering was performed at a temperature of 300° C. for 140 seconds. Subsequently, the steel sheets were pickled in an aqueous solution containing 5 mass % of sulfuric acid having a temperature of 40° C. Some of the steel sheets were subjected to electrolytic pickling respectively with current densities given in Table 2 in order to obtain samples, in which alternate current electrolysis was performed with the sample being set at the anode and the cathode in this order for 3 seconds each. Here, the dew point in ranges in the annealing furnace other than those in which the dew point was controlled was −35° C. In addition, the chemical composition of the atmospheric gas contained nitrogen gas, hydrogen gas, and inevitable impurities, and the dew point was controlled by removing water in the atmosphere by performing absorption removal. The hydrogen concentration in the atmosphere was 10 vol %.

The tensile strength (TS) and elongation (El) of the samples obtained as described above were determined. In addition, phosphatability and corrosion resistance after electrodeposition coating had been performed were investigated. In addition, the amount of oxides (the amount of internal oxides) which existed immediately under the surface layer of the steel sheet within 100 μm from the surface of the steel sheet was determined. The methods for the determination and the evaluation criteria will be described hereafter.

<Phosphatability>

A chemical conversion treatment was performed by using a chemical conversion treatment solution (PALEOND L-3080 (registered trademark)) produced by Nihon Parkerizing Co., Ltd. as a chemical conversion treatment solution and by using the method described below.

The sample was degreased by using a degreasing solution FINECLEANER (registered trademark) produced by Japan Parkerizing Co., Ltd., then washed with water, then subjected to surface conditioning for 30 seconds by using a surface conditioning solution PREPALENE-Z (registered trademark) produced by Japan Parkerizing Co., Ltd., then immersed in the chemical conversion solution (PALBOND L-3080) having a temperature of 43° C. for 120 seconds, then washed with water, and then dried with hot air.

By observing randomly selected 5 fields of view of each of the samples which had been subjected to a chemical conversion treatment by using a scanning electron microscope (SEM) at a magnification of 500 times, and by determining the area ratio of a lack of hiding of the chemical conversion coating by using image analysis, evaluation was performed on the basis of the area ratio of a lack of hiding as described below. Mark ○ corresponds to a satisfactory level.

○: 10% or less x: more than 10%

<Corrosion Resistance after Electrodeposition Coating has been Performed>

A test piece of 70 mm×150 mm was taken from the sample which had been subjected to a chemical conversion treatment obtained by using the method described above, and subjected to cation electrodeposition coating (baking condition: 170° C.×20 minutes, film thickness: 25 μm) by using the PN-150G (registered trademark) produced by Nippon Paint Co., Ltd. Subsequently, the end surfaces and the surface which was not to be evaluated were sealed with Al tapes, and the test piece was subjected to cross cut (crossing angle: 60°) reaching the steel sheet by using a cutter knife in order to obtain a sample.

Subsequently, the sample was immersed in a 5%-NaCl aqueous solution (55° C.) for 240 hours, then taken out of the solution, then washed with water, then dried, then subjected to a tape peeling test for the cross-cut portions in order to determine a peeling width, and then evaluated as described below. Mark ○ corresponds to a satisfactory level.

○: peeling width is less than 2.5 mm per side x: peeling width is 2.5 mm or more per side <Workability>

Workability was evaluated as described below. A tensile test was performed with a constant crosshead speed of 10 mm/min in accordance with the prescription in JIS Z 2241 on a JIS No. 5 tensile test piece which had been taken from the sample in the direction at a right angle to the rolling direction in order to determine tensile strength (TS/MPa) and elongation (El/%), and a case where TS×El was 20000 or more was judged as good while a case where TS×El was less than 20000 was judged as poor <Amount of Internal Oxidation within 100 μm from Surface Layer of Steel Sheet>

The amount of internal oxidation was determined by using an "impulse furnace melting-infrared absorption method". Here, since it was necessary to subtract the amount of oxygen of the raw material (that is, a high-strength steel sheet before being subjected to annealing), in the present EXAMPLES, the amount of oxygen OH contained in the raw material was defined as a determined value obtained by performing polishing in order to take off the surface layers having a thickness of 100 μm or more on both surfaces of the high-strength steel sheet which had been subjected to continuous annealing and by determining the oxygen concentration in steel, and the amount of oxygen OI after internal oxidation had been performed was defined as a determined value obtained by determining the oxygen concentration in steel in the whole thickness of the high-strength steel sheet which had been subjected to continuous annealing. The amount of internal oxidation was defined as a converted value obtained by using the amount of oxygen OI of the high-strength steel sheet after internal oxidation had been performed and the amount of oxygen OH contained in the raw material, by calculating the difference between OI and OH (=OI−OH), and by converting the difference into a value per unit area (that is, 1 $m^2$) per side ($g/m^2$).

The results obtained as described above are given in Table 2 along with the manufacturing conditions.

TABLE 2

| | Steel | | | | Annealing Furnace | | | | | | | | | Corrosion Resistance | | | | | |
|---|---|---|---|---|---|---|---|---|---|---|---|---|---|---|---|---|---|---|---|
| No. | Steel Code | Si (mass %) | Mn (mass %) | Cold or Hot Rolling | Healing Rate from 450° C. to A° C. (° C./s) | Dew Point at or above 600° C. (° C.) | A (° C.) | Maximum End-point Temperature of steel sheet (° C.) | Steel Sheet Traveling Time (min) | Amount of Internal Oxidation ($g/m^2$) | with or without Electrolytic Pickling | Current Density ($A/dm^2$) | Phosphal-ability | after Electro-deposition Coating | TS (MPa) | El (%) | TS × El | Work-ability | Note |
| 1 | A | 0.02 | 4.4 | Cold | 12 | −20 | 550 | 650 | 1.5 | 0.103 | without | — | X | X | 1087 | 21.8 | 23261 | good | Comparative Example |
| 2 | A | 0.02 | 4.4 | Cold | 12 | −30 | 550 | 650 | 1.5 | 0.059 | without | — | X | X | 1053 | 20.9 | 22008 | good | Comparative Example |
| 3 | A | 0.02 | 4.4 | Cold | 12 | −39 | 560 | 550 | 1.5 | 0.032 | without | — | X | ○ | 1056 | 21.0 | 22176 | good | Comparative Example |
| 4 | A | 0.02 | 4.4 | Cold | 12 | −40 | 550 | 850 | 1.5 | 0.029 | without | — | ○ | ○ | 1049 | 20.9 | 21924 | good | Example |
| 5 | A | 0.02 | 4.4 | Cold | 12 | −45 | 550 | 550 | 1.5 | 0.019 | without | — | ○ | ○ | 1055 | 21.8 | 22999 | good | Example |
| 6 | A | 0.02 | 4.4 | Cold | 12 | −45 | 550 | 595 | 1.5 | 0.018 | without | — | ○ | ○ | 895 | 22.1 | 19780 | poor | Comparative Example |
| 7 | A | 0.02 | 4.4 | Cold | 12 | −45 | 550 | 500 | 1.5 | 0.019 | without | — | ○ | ○ | 930 | 21.9 | 20367 | good | Example |
| 8 | A | 0.02 | 4.4 | Cold | 12 | −45 | 550 | 680 | 1.5 | 0.021 | without | — | ○ | ○ | 1056 | 20.8 | 21965 | good | Example |
| 9 | A | 0.02 | 4.4 | Cold | 12 | −45 | 550 | 700 | 1.5 | 0.024 | without | — | ○ | ○ | 1120 | 20.4 | 22848 | good | Example |
| 10 | A | 0.02 | 4.4 | Cold | 12 | −45 | 550 | 705 | 1.5 | 0.025 | without | — | X | ○ | 1136 | 19.8 | 22246 | good | Comparative Example |
| 11 | A | 0.02 | 4.4 | Cold | 12 | −45 | 550 | 650 | 0.4 | 0.021 | without | — | ○ | ○ | 956 | 20.7 | 19789 | poor | Comparative Example |
| 12 | A | 0.02 | 4.4 | Cold | 12 | −45 | 650 | 650 | 0.5 | 0.022 | without | — | ○ | ○ | 1012 | 21.5 | 21758 | good | Example |
| 13 | A | 0.02 | 4.4 | Cold | 12 | −45 | 550 | 650 | 5.0 | 0.023 | without | — | ○ | ○ | 1064 | 21.6 | 22982 | good | Example |
| 14 | A | 0.02 | 4.4 | Cold | 12 | −45 | 550 | 660 | 10.0 | 0.025 | without | — | ○ | ○ | 1070 | 22.0 | 23540 | good | Example |
| 15 | A | 0.02 | 4.4 | Hot | 12 | −45 | 550 | 650 | 1.5 | 0.020 | without | — | ○ | ○ | 1051 | 21.9 | 23017 | good | Example |
| 16 | A | 0.02 | 4.4 | Cold | 12 | −50 | 550 | 850 | 1.5 | 0.013 | without | — | ○ | ○ | 1059 | 20.6 | 21815 | good | Example |
| 17 | A | 0.02 | 4.4 | Cold | 12 | −60 | 550 | 650 | 1.5 | 0.007 | without | — | ○ | ○ | 1049 | 20.8 | 21819 | good | Example |
| 18 | A | 0.02 | 4.4 | Cold | 1 | −45 | 560 | 850 | 1.5 | 0.018 | without | — | X | X | 1061 | 20.3 | 21538 | good | Comparative Example |
| 19 | A | 0.02 | 4.4 | Cold | 3 | −45 | 550 | 650 | 1.5 | 0.016 | without | — | X | X | 1049 | 21.5 | 22554 | good | Comparative Example |
| 20 | A | 0.02 | 4.4 | Cold | 5 | −45 | 550 | 650 | 1.5 | 0.017 | without | — | X | ○ | 1043 | 21.8 | 22737 | good | Comparative Example |
| 21 | A | 0.02 | 4.4 | Cold | 9 | −45 | 550 | 650 | 1.5 | 0.015 | without | — | ○ | ○ | 1052 | 20.8 | 21882 | good | Example |
| 22 | A | 0.02 | 4.4 | Cold | 30 | −45 | 550 | 550 | 1.5 | 0.017 | without | — | ○ | ○ | 1046 | 20.9 | 21861 | good | Example |
| 23 | A | 0.02 | 4.4 | Cold | 100 | −45 | 550 | 850 | 1.5 | 0.016 | without | — | ○ | ○ | 1047 | 21.6 | 22615 | good | Example |
| 24 | A | 0.02 | 4.4 | Cold | 12 | −45 | 495 | 650 | 1.5 | 0.015 | without | — | X | X | 1039 | 20.5 | 21300 | good | Comparative Example |
| 25 | A | 0.02 | 4.4 | Cold | 12 | −45 | 500 | 650 | 1.5 | 0.017 | without | — | ○ | ○ | 1055 | 20.3 | 21417 | good | Example |
| 26 | A | 0.02 | 4.4 | Cold | 12 | −45 | 525 | 650 | 1.5 | 0.018 | without | — | ○ | ○ | 1043 | 21.0 | 21903 | good | Example |
| 27 | A | 0.02 | 4.4 | Cold | 12 | −45 | 576 | 650 | 1.5 | 0.016 | without | — | ○ | ○ | 1060 | 20.6 | 21630 | good | Example |
| 28 | A | 0.02 | 4.4 | Cold | 12 | −45 | 800 | 850 | 1.5 | 0.017 | without | — | ○ | ○ | 1059 | 19.7 | 20862 | good | Example |
| 29 | A | 0.02 | 4.4 | Cold | 12 | −45 | 550 | 650 | 1.5 | 0.018 | with | 1 | ○ | ○ | 1049 | 20.0 | 20980 | good | Example |
| 30 | A | 0.02 | 4.4 | Cold | 12 | −45 | 550 | 850 | 1.5 | 0.017 | with | 3 | ○ | ○ | 1051 | 20.3 | 21335 | good | Example |
| 31 | A | 0.02 | 4.4 | Cold | 12 | −45 | 550 | 650 | 1.5 | 0.018 | with | 10 | ○ | ○ | 1056 | 20.8 | 21965 | good | Example |

TABLE 2-continued

| | Steel | | | | Annealing Furnace | | | | | | | | | | | | | | |
|---|---|---|---|---|---|---|---|---|---|---|---|---|---|---|---|---|---|---|---|
| No. | Steel Code | Si (mass %) | Mn (mass %) | Cold or Hot Rolling | Healing Rate from 450° C. to A° C. (° C./s) | Dew Point at or above 600° C. (° C.) | A (° C.) | Maximum End-point Temperature of steel sheet (° C.) | Steel Sheet Traveling Time (min) | Amount of Internal Oxidation ($g/m^2$) | with or without Electrolytic Pickling | Current Density ($A/dm^2$) | Phosphal-ability | Corrosion Resistance after Electro-deposition Coating | TS (MPa) | El (%) | TS × El | Work-ability | Note |
| 32 | B | 0.02 | 4.5 | Cold | 12 | −45 | 550 | 650 | 1.5 | 0.011 | without | — | ○ | ○ | 1038 | 21.9 | 22732 | good | Example |
| 33 | C | 0.02 | 4.8 | Cold | 12 | −45 | 550 | 650 | 1.5 | 0.010 | without | — | ○ | ○ | 1047 | 21.5 | 22511 | good | Example |
| 34 | D | 0.11 | 4.8 | Cold | 12 | −45 | 550 | 650 | 1.5 | 0.016 | without | — | ○ | ○ | 1040 | 20.9 | 21736 | good | Example |
| 35 | E | 0.31 | 4.7 | Cold | 12 | −45 | 550 | 850 | 1.5 | 0.019 | without | — | ○ | ○ | 1043 | 20.6 | 21486 | good | Example |
| 36 | F | 0.49 | 4.5 | Cold | 12 | −45 | 550 | 650 | 1.5 | 0.020 | without | — | ○ | ○ | 1054 | 20.8 | 21923 | good | Example |
| 37 | G | 0.02 | 3.7 | Cold | 12 | −45 | 550 | 550 | 1.5 | 0.018 | without | — | ○ | ○ | 1050 | 21.0 | 22050 | good | Example |
| 38 | H | 0.03 | 6.2 | Cold | 12 | −45 | 550 | 850 | 1.5 | 0.017 | without | — | ○ | ○ | 1058 | 20.9 | 22112 | good | Example |
| 39 | I | 0.02 | 0.1 | Cold | 12 | −45 | 550 | 650 | 1.5 | 0.015 | without | — | X | ○ | 1054 | 20.4 | 21502 | good | Comparative Example |
| 40 | J | 0.02 | 4.8 | Cold | 12 | −45 | 550 | 650 | 1.5 | 0.020 | without | — | ○ | ○ | 1055 | 20.7 | 21839 | good | Example |
| 41 | K | 0.05 | 4.5 | Cold | 12 | −45 | 550 | 650 | 1.6 | 0.019 | without | — | ○ | ○ | 1048 | 20.8 | 21798 | good | Example |
| 42 | L | 0.02 | 4.6 | Cold | 12 | −45 | 550 | 650 | 1.8 | 0.016 | without | — | ○ | ○ | 1059 | 20.1 | 21288 | good | Example |
| 43 | M | 0.03 | 4.4 | Cold | 12 | −45 | 550 | 650 | 1.5 | 0.017 | without | — | ○ | ○ | 1052 | 19.9 | 20935 | good | Example |
| 44 | N | 0.03 | 4.6 | Cold | 12 | −45 | 550 | 650 | 1.5 | 0.018 | without | — | ○ | ○ | 1046 | 20.9 | 21861 | good | Example |
| 45 | O | 0.02 | 4.7 | Cold | 12 | −45 | 550 | 850 | 1.5 | 0.016 | without | — | ○ | ○ | 1048 | 21.3 | 22322 | good | Example |
| 46 | P | 0.03 | 4.5 | Cold | 12 | −45 | 550 | 650 | 1.5 | 0.019 | without | — | ○ | ○ | 1055 | 19.8 | 20889 | good | Example |
| 47 | Q | 0.02 | 4.6 | Cold | 12 | −45 | 550 | 650 | 1.5 | 0.016 | without | — | ○ | ○ | 1052 | 20.0 | 21040 | good | Example |
| 48 | R | 0.03 | 4.5 | Cold | 12 | −45 | 550 | 650 | 1.5 | 0.017 | without | — | ○ | ○ | 1059 | 21.0 | 22239 | good | Example |
| 49 | S | 0.02 | 4.6 | Cold | 12 | −45 | 550 | 650 | 1.5 | 0.015 | without | — | ○ | ○ | 1052 | 20.4 | 21461 | good | Example |
| 50 | T | 0.03 | 4.7 | Cold | 12 | −45 | 550 | 650 | 1.5 | 0.016 | without | — | ○ | ○ | 1058 | 20.3 | 21477 | good | Example |
| 51 | U | 0.02 | 4.7 | Cold | 12 | −45 | 550 | 850 | 1.5 | 0.018 | without | — | ○ | ○ | 1047 | 20.3 | 21254 | good | Example |
| 52 | U1 | 0.02 | 4.5 | Cold | 12 | −45 | 550 | 850 | 1.5 | 0.019 | without | — | ○ | ○ | 1042 | 20.7 | 21569 | good | Example |
| 53 | U2 | 0.03 | 4.6 | Cold | 12 | −45 | 550 | 650 | 1.5 | 0.017 | without | — | ○ | ○ | 1050 | 20.9 | 21945 | good | Example |
| 54 | U3 | 0.03 | 4.5 | Cold | 12 | −45 | 550 | 550 | 1.5 | 0.016 | without | — | ○ | ○ | 1043 | 20.5 | 21382 | good | Example |
| 55 | U4 | 0.03 | 4.6 | Cold | 12 | −45 | 550 | 650 | 1.5 | 0.014 | without | — | ○ | ○ | 1044 | 22.3 | 23281 | good | Example |
| 56 | U5 | 0.03 | 4.7 | Cold | 12 | −45 | 550 | 650 | 1.5 | 0.015 | without | — | ○ | ○ | 1059 | 19.9 | 21074 | good | Example |
| 57 | XA | 0.03 | 4.5 | Cold | 12 | −45 | 550 | 650 | 1.5 | 0.018 | without | — | ○ | ○ | 1309 | 13.2 | 17279 | poor | Comparative Example |
| 58 | XB | 0.02 | 4.6 | Cold | 12 | −45 | 550 | 650 | 1.5 | 0.020 | without | — | ○ | ○ | 993 | 15.3 | 15193 | poor | Comparative Example |
| 59 | XC | 0.59 | 4.5 | Cold | 12 | −45 | 550 | 650 | 1.5 | 0.026 | without | — | X | ○ | 1133 | 12.0 | 13598 | poor | Comparative Example |
| 60 | XD | 0.02 | 3.5 | Cold | 12 | −45 | 550 | 650 | 1.5 | 0.022 | without | — | X | X | 1090 | 20.4 | 22236 | good | Comparative Example |
| 61 | XE | 0.02 | 4.5 | Cold | 12 | −45 | 550 | 850 | 1.5 | 0.027 | without | — | X | X | 1158 | 20.2 | 23392 | good | Comparative Example |
| 62 | XF | 0.03 | 4.6 | Cold | 12 | −45 | 550 | 850 | 1.5 | 0.021 | without | — | X | ○ | 1190 | 18.9 | 22491 | good | Comparative Example |
| 63 | XG | 0.02 | 4.5 | Cold | 12 | −45 | 550 | 650 | 1.5 | 0.016 | without | — | ○ | X | 1099 | 19.9 | 21870 | good | Comparative Example |

An underlined portion indicates a manufacturing conditions out of the range according to the disclosed embodiments As table 2 indicates, it is clarified that the high-strength steel sheets manufactured by using the method according to the disclosed embodiments were excellent in terms of phosphatability, corrosion resistance after electrodeposition coating had been performed, and workability despite containing a large amount of oxidizable chemical elements such as Si and Mn. On the other hand, the comparative examples were poor in terms of one or more of phosphatability, corrosion resistance after electrodeposition coating had been performed, and workability.

Since the high-strength steel sheet according to the disclosed embodiments is excellent in terms of phosphatability, corrosion resistance, and workability, it is possible to use the steel sheet as a surface-treated steel sheet for the weight reduction and strengthening of automobile bodies. Also, it is possible to use the steel sheet as a surface-treated steel sheet, in which untreated steel sheets have been provided with rust prevention capability, in wide fields such as domestic electrical appliance and architectural material industries in addition to automobile industry.

The invention claimed is:

1. A method for manufacturing a high-strength steel sheet, the method comprising, when annealing by a continuous annealing method a steel sheet having a chemical composition comprising: C: 0.03% to 0.35%, by mass %, Si: 0.01% to 0.50%, by mass %, Mn: 3.6% to 8.0%, by mass %, Al: 0.01% to 1.0%, by mass %, P: 0.10% or less, by mass %, S: 0.010% or less, by mass %, and Fe and incidental impurities:

performing a heating process in an annealing furnace at a heating rate of 7° C./s or more at a temperature in the range of 450° C. to A° C., where A: $500 \leq A \leq 600$;

controlling the maximum end-point temperature of the steel sheet in the annealing furnace to be in the range of 600° C. to 700° C.;

controlling the traveling time of the steel sheet in a steel sheet temperature range of 600° C. to 700° C. to be in the range of 30 seconds to 10 minutes; and controlling the dew point of the atmosphere in the steel sheet temperature range of 600° C. to 700° C. to be −40° C. or lower.

2. The method for manufacturing a high-strength steel sheet according to claim 1, wherein the chemical composition further comprises one or more elements selected from the group consisting of B: 0.001% to 0.005%, by mass %, Nb: 0.005% to 0.05%, by mass %, Ti: 0.005% to 0.05%, by mass %, Cr: 0.001% to 1.0%, by mass %, Mo: 0.05% to 1.0%, by mass %, Cu: 0.05% to 1.0%, by mass %, Ni: 0.05% to 1.0%, by mass %, Sn: 0.001% to 0.20%, by mass %, Sb: 0.001% to 0.20%, by mass %, Ta: 0.001% to 0.10%, by mass %, W: 0.001% to 0.10%, by mass %, and V: 0.001% to 0.10% by mass %.

3. The method for manufacturing a high-strength steel sheet according to claim 1, the method further comprising, after performing the annealing by the continuous annealing method, performing electrolytic pickling in an aqueous solution containing sulfuric acid.

4. The method for manufacturing a high-strength steel sheet according to claim 2, the method further comprising, after performing the annealing by the continuous annealing method, performing electrolytic pickling in an aqueous solution containing sulfuric acid.

* * * * *